US008065902B2

(12) United States Patent
Kono et al.

(10) Patent No.: US 8,065,902 B2
(45) Date of Patent: Nov. 29, 2011

(54) HEMMING APPARATUS

(75) Inventors: Masaru Kono, Hiroshima (JP); Satoshi Takemoto, Hiroshima (JP)

(73) Assignee: Hirotec Corporation, Hiroshima (JP)

( * ) Notice: Subject to any disclaimer, the term of this patent is extended or adjusted under 35 U.S.C. 154(b) by 615 days.

(21) Appl. No.: 12/273,319

(22) Filed: Nov. 18, 2008

(65) Prior Publication Data

US 2009/0139294 A1 Jun. 4, 2009

(30) Foreign Application Priority Data

Dec. 3, 2007 (JP) ..... 2007-312488

(51) Int. Cl.
*B21D 11/00* (2006.01)

(52) U.S. Cl. ..... 72/315; 72/452.1; 72/452.3; 29/243.57; 29/243.58

(58) Field of Classification Search ..... 72/312–315, 72/452.1, 452.9, 407, 322, 323; 29/243.57, 29/243.58

See application file for complete search history.

(56) References Cited

U.S. PATENT DOCUMENTS 5,050,422 A * 9/1991 Dorsett ..... 72/450
6,295,858 B1 * 10/2001 Torito ..... 72/315
2006/0168789 A1 * 8/2006 Sasahara ..... 29/281.1

FOREIGN PATENT DOCUMENTS

JP 2000-051971 A 2/2000
JP 3598489 B2 9/2004

* cited by examiner

*Primary Examiner* — Dana Ross
*Assistant Examiner* — Matthew G Katcoff
(74) *Attorney, Agent, or Firm* — Roberts Mlotkowski Safran & Cole, P.C.

(57) ABSTRACT

A lower platen of the hemming apparatus is provided with a hem punch capable of being pressed against an inner periphery bent portion of a workpiece having a frame and a cam follower. The cam follower is disposed on the lower platen to come outside the frame of the workpiece. The cam follower and the hem punch are connected through a connecting member. An upper platen of the hemming apparatus is provided with a driver cam engageable against the cam follower. The driver cam moves the cam follower, whereby the hem punch is pressed against the inner periphery bent portion.

4 Claims, 14 Drawing Sheets

HEMMING APPARATUS

CROSS-REFERENCE TO RELATED APPLICATION

This application claims priority under 35 USC 119 to Japanese Patent Application No. 2007-312488 filed on Dec. 3, 2007, the entire contents of which are incorporated herein by reference.

BACKGROUND OF THE INVENTION (a) Field of the Invention

This invention relates to hemming apparatuses for hemming a workpiece made such as of a metal plate.

(b) Description of Related Art

An example of conventionally known hemming apparatuses for hemming a workpiece, such as a door panel for a motor vehicle, is that disclosed in Japanese Patent Publication No. 3598489. The hemming apparatus disclosed in Japanese Patent Publication No. 3598489 includes upper and lower platens arranged opposite to each other and hems a workpiece having a frame, such as a door panel. Specifically, the hemming apparatus is configured to hem an outer periphery bent portion and an inner periphery bent portion of the workpiece formed at the outer periphery and the inner periphery, respectively, of the workpiece.

The lower platen of the above hemming apparatus includes a support table for supporting a workpiece thereon, inner periphery hem punches for hemming an inner periphery bent portion of the workpiece, inner periphery slide cam units supporting the associated inner periphery hem punches to allow them to move in a direction towards and away from the inner periphery bent portion of the workpiece, outer periphery hem punches for hemming an outer periphery bent portion of the workpiece, and outer periphery link cam units supporting the associated outer periphery hem punches to allow them to move in a direction towards and away from the outer periphery bent portion of the workpiece. The inner periphery hem punches and the inner periphery slide cam units are disposed inside the frame of the workpiece supported on the lower platen.

On the other hand, the upper platen includes inner periphery driver cam units configured to engage against associated cam followers of the inner periphery slide cam units to drive the associated inner periphery hem punches, and outer periphery driver cam units configured to engage against associated cam followers of the outer periphery link cam units to drive the associated outer periphery hem punches.

When the upper platen moves down, the inner periphery driver cam units of the upper platen engage against the associated cam followers of the inner periphery slide cam units of the lower platen and the inner periphery hem punches are thereby pressed against the inner periphery bent portion of the workpiece, so that hemming forces act on the inner periphery bent portion. At this time, the outer periphery driver cam units of the upper platen engage against the associated cam followers of the outer periphery link cam units of the lower platen, so that hemming forces likewise act on the outer periphery bent portion of the workpiece. In this manner, the outer periphery bent portion and inner periphery bent portion of the workpiece are hemmed.

In order to hem an inner periphery bent portion of a workpiece having a frame as described above, it will do well to provide the inner periphery hem punches and the inner periphery slide cam units on the lower platen so that they come inside the frame of the workpiece. However, there may be workpieces having small frames. In such a case, it is difficult to arrange the inner periphery slide cam units within the frame of the workpiece. To cope with this, it can be considered that the hemming apparatus includes two lower platens, one of the two lower platens has small first inner periphery hem punches and first inner periphery slide cam units provided to come inside the frame of the workpiece and hem part of the inner periphery bent portion of the workpiece and the other lower platen has small second inner periphery hem punches and second inner periphery slide cam units provided likewise to come inside the frame of the workpiece and hem the remaining part of the inner periphery bent portion of the workpiece. Thus, it is possible that after part of the inner periphery bent portion of the workpiece is hemmed by one lower platen, the workpiece is removed from the one lower platen and supported by the other lower platen and the remaining part of the inner periphery bent portion of the workpiece is hemmed by the other lower platen. In this case, however, the number of process steps increases, thereby increasing the man-hour and in turn causing cost rise. In addition, since two kinds of lower platens are provided, this increases the equipment cost and also causes cost rise. Furthermore, since the workpiece is removed from one lower platen and supported by the other lower platen, a misalignment of the workpiece from the support table inevitably occurs, which invites deteriorated processing precision and in turn may degrade the product quality.

The present invention has been made in view of the foregoing points and, therefore, an object thereof is to allow an inner periphery bent portion of a workpiece having a frame to be hemmed in a single step with a single platen, thereby reducing the cost while giving the product a good quality.

SUMMARY OF THE INVENTION

The present invention is directed to a hemming apparatus for hemming an inner periphery bent portion of a workpiece having a frame, the inner periphery bent portion being previously formed at the inner periphery of the workpiece, wherein the hemming apparatus includes: a first platen including a support table for supporting the workpiece thereon; and a second platen disposed to face the first platen. The first platen further includes an inner periphery hem punch disposed to come inside the frame of the workpiece and capable of being pressed against the inner periphery bent portion, an outside cam follower disposed to come outside the frame of the workpiece, and a connecting member connecting the outside cam follower and the inner periphery hem punch to transmit the movement of the outside cam follower to the inner periphery hem punch. The second platen includes an outside driver cam engageable against the outside cam follower by relative movement of the second platen towards the first platen. The outside driver cam is configured to move the outside cam follower so that the inner periphery hem punch reaches a position to be pressed against the inner periphery bent portion.

According to the above configuration, when, for example, the second platen is moved towards the first platen, the outside driver cam of the second platen engages against the outside cam follower of the first platen, whereby the movement of the outside cam follower is transmitted through the connecting member to the inner periphery hem punch. Thus, the inner periphery hem punch reaches a position to be pressed against the inner periphery bent portion of the workpiece, so that the inner periphery bent portion is hemmed by the inner periphery hem punch. In this manner, the movement of the outside cam follower can be transmitted to the inner periphery hem punch. Therefore, even if the opening of the workpiece is too small to dispose the cam follower therewithin, the entire inner periphery bent portion of the workpiece can be hemmed in a single step with a single die. This reduces the cost while giving the product a good quality.

The connecting member is preferably disposed to the opposite side of the workpiece supported on the support table to the second platen.

The first platen may include a first inner periphery hem punch, a second inner periphery hem punch and an inside cam follower connected to the first inner periphery hem punch, the first and second inner periphery hem punches and the inside cam follower being disposed to come inside the frame of the workpiece, the second inner periphery hem punch and the outside cam follower may be connected through the connecting member, the second platen may further include an inside driver cam engageable against the inside cam follower by relative movement of the second platen towards the first platen, and the inside driver cam may be configured to move the inside cam follower so that the first inner periphery hem punch reaches a position to be pressed against the inner periphery bent portion.

Thus, when, for example, the second platen is moved towards the first platen, the inside driver cam of the second platen engages against the inside cam follower of the first platen and the movement of the inside cam follower causes the first inner periphery hem punch to reach a position to be pressed against the inner periphery bent portion of the workpiece, so that the inner periphery bent portion is hemmed by the first inner periphery hem punch. Furthermore, the movement of the outside cam follower causes the second inner periphery hem punch to reach a position to be pressed against the inner periphery bent portion of the workpiece.

In other words, when the inner periphery bent portion of the workpiece is hemmed by the first and second inner periphery hem punches, the first inner periphery hem punch can be moved by the inside cam follower disposed to come inside the frame of the workpiece and the second inner periphery hem punch can be moved by the outside cam follower disposed to come outside the frame of the workpiece.

The first platen preferably further includes a return spring for the outside cam follower, the return spring being disposed to come outside the frame of the workpiece.

Thus, there is no need to dispose the return spring for the outside cam follower to come inside the frame of the workpiece. Therefore, the inner periphery bent portion of the workpiece can be hemmed even when the opening of the workpiece is still smaller.

DETAILED DESCRIPTION OF THE INVENTION

A detailed description is given below of an embodiment of the present invention with reference to the drawings. The following description of the preferred embodiment is merely illustrative in nature and is not intended to limit the scope, applications and use of the invention.

Figure 1:
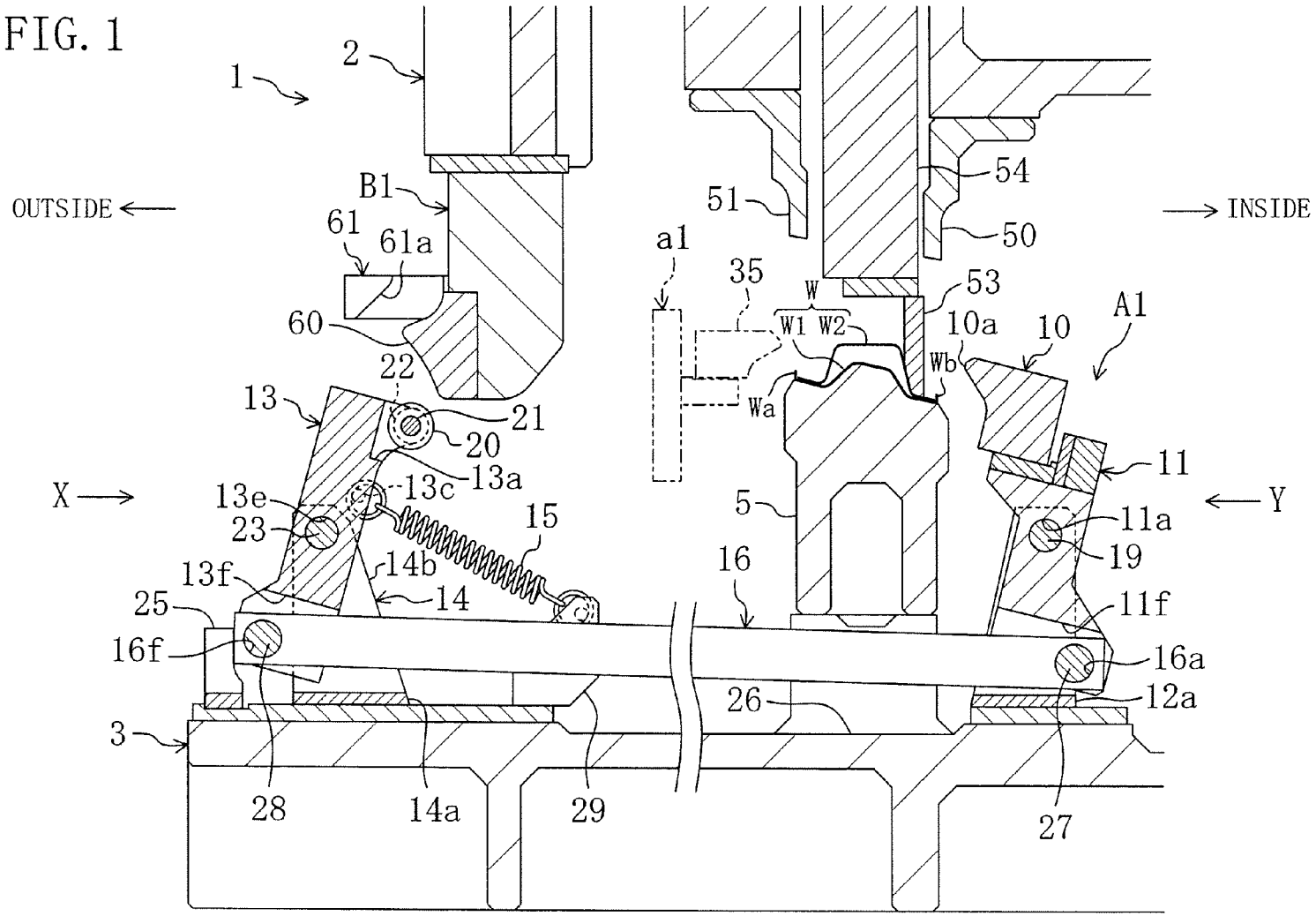
FIG. 1 is a cross-sectional view showing a first inner periphery pre-hemming mechanism of a hemming apparatus according to an embodiment of the present invention.

As shown in FIG. 1, a hemming apparatus 1 according to an embodiment of the invention includes upper and lower platens 2 and 3 disposed to vertically face each other, and a driving mechanism (not shown) for vertically moving the upper platen 2 towards and away from the lower platen 3. The driving mechanism is constituted, such as by a well-known hydraulic cylinder.

Workpieces W to be processed by the hemming apparatus 1 are doors to be fitted to motor vehicles. A sash (frame) for supporting a window glass is provided in a part of the door constituting an upper part thereof when the door is fitted to a vehicle. The door includes an outer panel W1 constituting an exterior-side part thereof and an inner panel W2 constituting an interior-side part thereof. The outer panel W1 and the inner panel W2 are superposed on each other and joined together. Openings forming the sash are formed in the upper parts of the outer panel W1 and inner panel W2. The outer panel W1 has an outer periphery bent portion Wa formed over substantially the entire outer periphery thereof and an inner periphery bent portion Wb formed over substantially the entire periphery of the opening (substantially the entire inner periphery of the outer panel W1). The outer periphery bent portion Wa and the inner periphery bent portion Wb are formed to rise from the outer panel W1 towards the inner panel W2 in a direction substantially orthogonal to the outer surface of the outer panel W1 when the outer panel W1 is press formed. The outer periphery bent portion Wa is a portion to be folded down (hemmed) towards the outer periphery of the inner panel W2 by the above-stated hemming apparatus, and the inner periphery bent portion Wb is a portion to be likewise folded down (hemmed) towards the periphery of the opening of the inner panel W2. The outer periphery of the inner panel W2 is clamped under the outer panel W1 by hemming the outer periphery bent portion Wa and the periphery of the opening of the inner panel W2 is clamped under the outer panel W1 by hemming the inner periphery bent portion Wb, whereby the outer panel W1 and the inner panel W2 are joined together.

Figure 2:
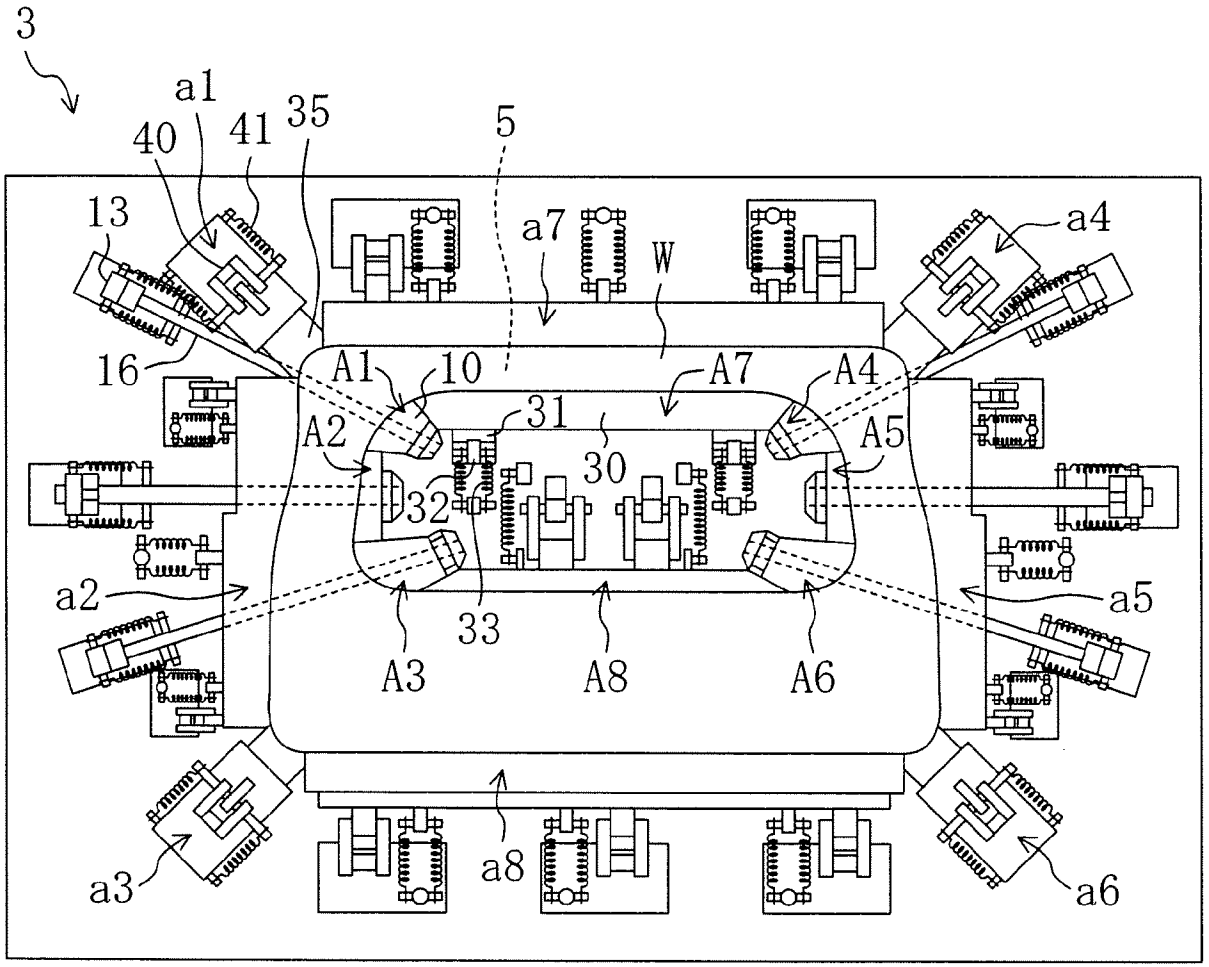
FIG. 2 is a plan view of a lower platen of the hemming apparatus.

As shown in FIG. 2, the top surface of the lower platen 3 is provided with first to eighth inner periphery pre-hemming mechanisms A1 to A8 according to the shape of the inner periphery of the workpiece W. The first to eighth inner periphery pre-hemming mechanisms A1 to A8 are used to preliminarily hem the inner periphery bent portion Wb of the outer panel W1. Preliminary hemming is to fold down the inner periphery bent portion Wb to a state just before being fully folded down.

The first inner periphery pre-hemming mechanism A1 is used to preliminarily hem the upper left corner of the inner periphery bent portion Wb of the outer panel W1 (when viewed in FIG. 2), and the second inner periphery pre-hemming mechanism A2 is used to preliminarily hem the left side of the inner periphery bent portion Wb. The third inner periphery pre-hemming mechanism A3 is used to preliminarily hem the lower left corner of the inner periphery bent portion Wb and the fourth inner periphery pre-hemming mechanism A4 is used to preliminarily hem the upper right corner of the inner periphery bent portion Wb (when viewed in FIG. 2). The fifth inner periphery pre-hemming mechanism A5 is used to preliminarily hem the right side of the inner periphery bent portion Wb and the sixth inner periphery pre-hemming mechanism A6 is used to preliminarily hem the lower right corner of the inner periphery bent portion Wb. The seventh inner periphery pre-hemming mechanism A7 is used to preliminarily hem the upper part of the inner periphery bent portion Wb and the eighth inner periphery pre-hemming mechanism A8 is used to preliminarily hem the lower part of the inner periphery bent portion Wb.

The top surface of the lower platen 3 is provided also with first to eighth outer periphery pre-hemming mechanisms a1 to a8 for preliminarily hemming the outer periphery bent portion Wa of the outer panel W1. The first to eighth outer periphery pre-hemming mechanisms a1 to a8 are disposed in correspondence with the first to eighth inner periphery pre-hemming mechanisms A1 to A8. Furthermore, the top surface of the lower platen 3 is provided with a hemming die 5 for supporting the workpiece W from below in a region thereof surrounded by the first to eighth outer periphery pre-hemming mechanisms a1 to a8. The hemming die 5 has an annular shape to conform to the shape of the workpiece W.

As shown in FIG. 1, the first inner periphery pre-hemming mechanism A1 includes a pre-hemming hem punch 10, a hem punch mounting member 11 on which the pre-hemming hem punch 10 is mounted, a hem punch-side bracket 12 supporting the hem punch mounting member 11, a cam follower 13, a follower-side bracket 14 supporting the cam follower 13, return springs 15, and a connecting member 16 connecting the hem punch mounting member 11 and the cam follower 13. The pre-hemming hem punch 10, the hem punch mounting member 11 and the hem punch-side bracket 12 are disposed on the lower platen 3 to come inside the opening of the outer panel W1 (inside the frame), while the cam follower 13, the follower-side bracket 14 and the return springs 15 are disposed on the lower platen 3 to come outside the opening of the outer panel W1 (outside the frame).

The pre-hemming hem punch 10 is formed to come alongside the upper left corner of the opening of the outer panel W1. The pre-hemming hem punch 10 has a forming part 10*a* extending from its top towards the outside of the lower platen 3. The forming part 10*a* is used to be pressed against the inner periphery bent portion Wb so that a hemming force acts on the inner periphery bent portion Wb.

Figure 3:
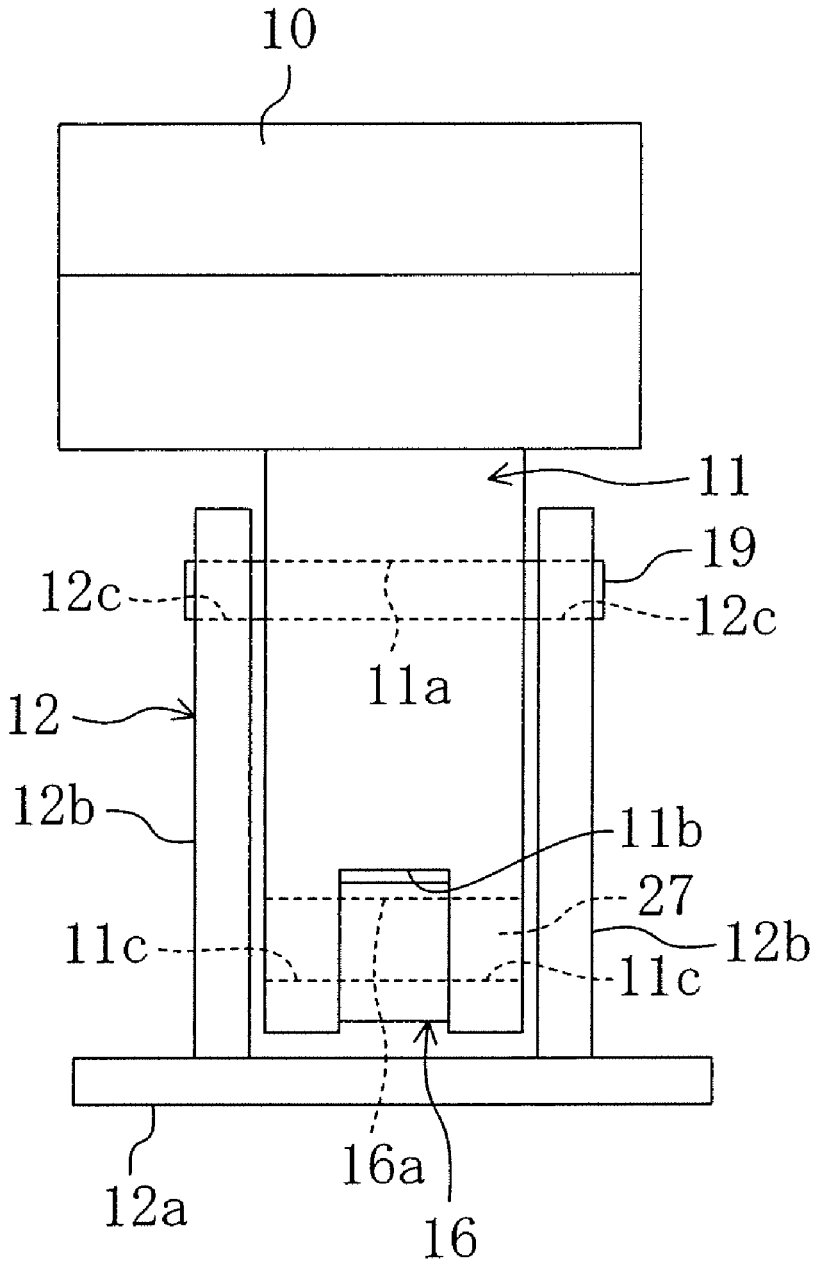
FIG. 3 shows the first inner periphery pre-hemming mechanism as viewed from the direction Y of FIG. 1.

The hem punch mounting member 11 has a vertically long shape. The bottom of the pre-hemming hem punch 10 is mounted on the top of the hem punch mounting member 11. As also shown in FIG. 3, the hem punch mounting member 11 has a bearing hole 11*a* formed at its vertically midpoint to pass through it horizontally. A bearing member (not shown) is fitted into the bearing hole 11*a*. The hem punch mounting member 11 has a recess 11*b* formed in its bottom to fit onto the connecting member 16. The portion of the hem punch mounting member 11 in which the recess 11*b* is formed has through holes 11*c* and 11*c* formed to extend in parallel with the bearing hole 11*a*.

The hem punch-side bracket 12 includes a bottom plate 12*a* fixed to the top surface of the lower platen 3 and a pair of side plates 12*b* and 12*b* extending upward from both sides of the top surface of the bottom plate 12*a*. The above hem punch mounting member 11 is interposed between both the side plates 12*b* and 12*b*. Both the side plates 12*b* and 12*b* have their respective through holes 12*c* and 12*c* formed in upper portions thereof concentrically with the bearing hole 11*a* in the hem punch mounting member 11. A horizontally extending hem punch-side shaft 19 is inserted into the through holes 12*c* and the bearing hole 11*a*, whereby the hem punch mounting member 11 can pivotally move about the hem punch-side shaft 19 relative to the hem punch-side bracket 12.

Figure 4:
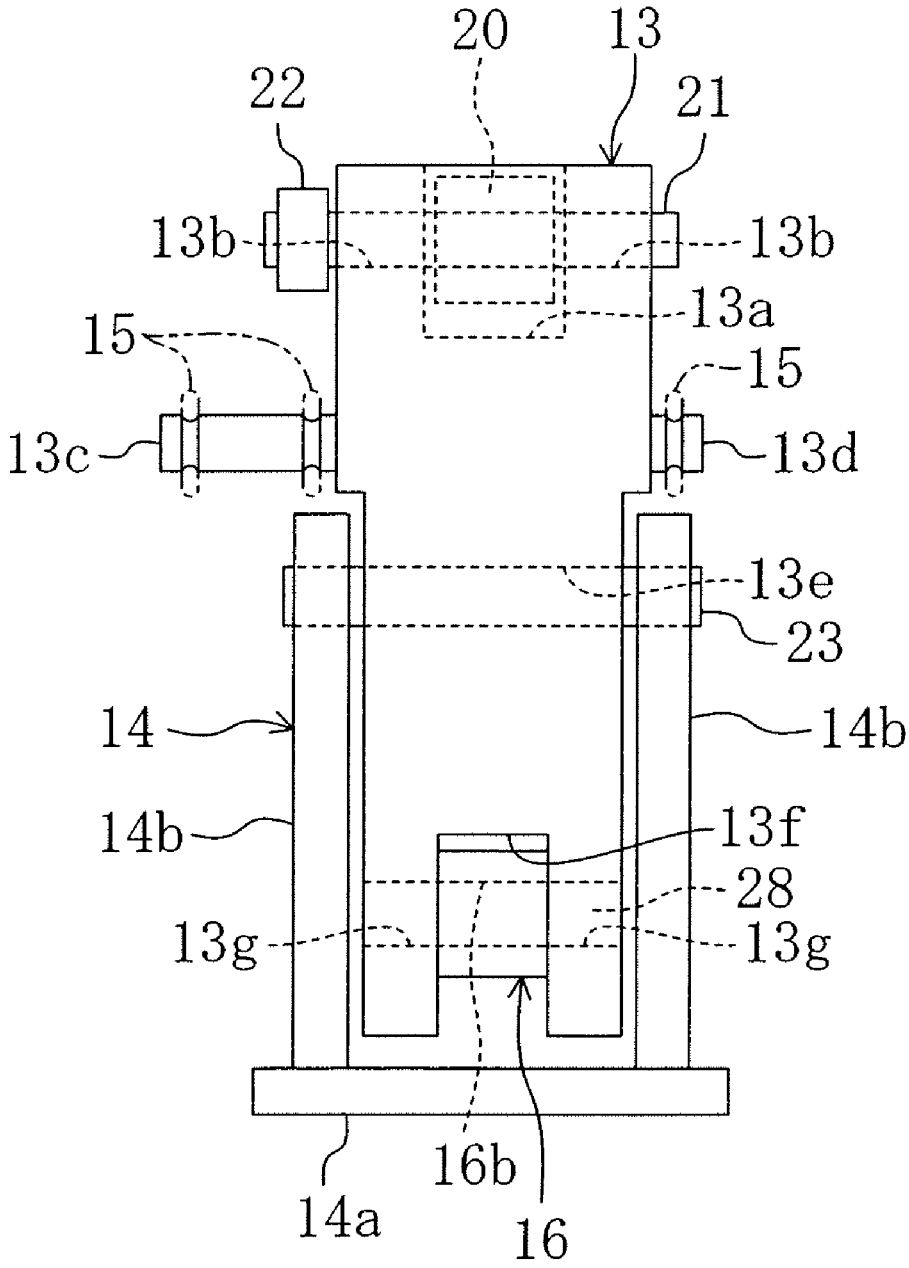
FIG. 4 shows the first inner periphery pre-hemming mechanism as viewed from the direction X of FIG. 1.

The cam follower 13 has a vertically long shape like the hem punch mounting member 11. The cam follower 13 has a roller placement recess 13*a* formed in its top to place a roller 20 thereinto. As also shown in FIG. 4, the portion of the cam follower 13 in which the roller placement recess 13*a* is formed has roller supporting through holes 13*b* and 13*b* formed to pass through it horizontally. The roller supporting through holes 13*b* and 13*b* extend in parallel with the bearing hole 11*a* in the hem punch mounting member 11. The roller 20 is supported by a shaft 21 inserted in the roller supporting through holes 13*b*, and thereby configured to be rotatable about the axis of the shaft 21. Furthermore, the roller 20 is configured to be engageable against the below-described driver cam to receive a force from the driver cam. The shaft 21 for the roller 20 extends beyond the side surfaces of the cam follower 13. A cylindrical member 22 is mounted on one of the extended portions of the shaft 21 concentrically with the shaft 21.

The cam follower 13 has first and second rods 13*c* and 13*d* extending from the side surfaces thereof below the roller placement recess 13*a*. The first rod 13*c* on one of the side surfaces is formed to be longer than the second rod 13*d* on the other side surface. Two return springs 15 and 15 are anchored at their one ends to the first rod 13*c*, while a single return spring 15 is anchored at its one end to the second rod 13*d*.

The cam follower 13 also has a bearing hole 13*e* formed below the first and second rods 13*c* and 13*d* to pass therethrough and extend in parallel with the roller supporting through holes 13*b*. A bearing member (not shown) is fitted into the bearing hole 13*e*. The cam follower 13 also has a lower recess 13*f* formed in its bottom to fit onto the connecting member 16. The portion of the cam follower 13 in which the lower recess 13*f* is formed has through holes 13*g* and 13*g* formed to extend in parallel with the bearing hole 13*e*.

The follower-side bracket 14 includes a bottom plate 14*a* fixed to the top surface of the lower platen 3 and a pair of side plates 14*b* and 14*b* extending upward from both sides of the top surface of the bottom plate 14*a*. The above cam follower 13 is interposed between both the side plates 14*b* and 14*b*. Both the side plates 14*b* and 14*b* have their respective through holes 14*c* and 14*c* formed in upper portions thereof concentrically with the bearing hole 13*e* in the cam follower 13. A horizontally extending follower-side shaft 23 is inserted into the through holes 14*c* and the bearing hole 13*e*, whereby the cam follower 13 can pivotally move about the follower-side shaft 23 relative to the follower-side bracket 14.

As shown in FIG. 1, the lower platen 3 is provided with a stopper 25 for restricting the pivotal movement of the cam follower 13. The stopper 25 is disposed to abut on the lower end of the cam follower 13 from outwardly of the cam follower 13.

The hemming die 5 has an insertion hole 26 formed in a lower part thereof to pass the connecting member 16 through the hemming die 5 from inside to outside thereof. The connecting member 16 is formed in the shape of a rod and disposed above the lower platen 3 to pass through the insertion hole 26 from inside to outside of the opening of the outer panel W1. In other words, the lower platen 3 has a tunnel structure in which the connecting member 16 passes through the lower part of the hemming die 5 in a direction from inside to outside of the hemming die 5.

As also shown in FIG. 3, the connecting member 16 has a bearing hole 16*a* formed at its portion (inner end) located inwardly of the hemming die 5 to pass through it horizontally. The connecting member 16 is placed so that its inner end is located in the recess 11*b* of the hem punch mounting member 11 and the bearing hole 16*a* is concentric with the through holes 11*c* and 11*c*. A shaft 27 is inserted into the bearing hole 16*a* and the through holes 11*c* and 11*c*.

As also shown in FIG. 4, like the inner end, the connecting member 16 has a bearing hole 16*b* formed at its portion (outer end) located outwardly of the hemming die 5 to pass through it horizontally. The connecting member 16 is placed so that its outer end is located in the lower recess 13*f* of the cam follower 13 and the bearing hole 16*b* is concentric with the through holes 13*g* and 13*g*. A shaft 28 is inserted into the bearing hole 16*b* and the through holes 13*g* and 13*g*.

In other words, the lower part of the hem punch mounting member 11 and the lower part of the cam follower 13 are connected by the connecting member 16, whereby the movement of the cam follower 13 is transmitted through the connecting member 16 and the hem punch mounting member 11 to the pre-hemming hem punch 10. Therefore, when the cam follower 13 is pivotally moved about the follower-side shaft 23, the hem punch mounting member 11 pivotally moves about the hem punch-side shaft 19. Through the pivotal movement of the hem punch mounting member 11 about the hem punch-side shaft 19, the forming part 10*a* of the pre-hemming hem punch 10 is switched between a standby position (shown in FIG. 1) away from the inner periphery bent portion Wb and a pre-hemming position (shown in FIG. 9) at which the forming part 10*a* is pressed against the inner periphery bent portion Wb to preliminarily hem it.

Furthermore, disposed on the lower platen 3 between the hemming die 5 and the follower-side bracket 14 is a return spring anchor member 29 at which the other ends of the return springs 15 are anchored. Each return spring 15 is used to urge a portion of the cam follower 13 located above the follower-side shaft 23 towards the hemming die 5 (the inside region of the lower platen 3) and composed of a well-known tension spring. The cam follower 13 is urged towards bringing the roller 20 close to the hemming die 5 by the return springs 15 and, in this state, the lower part of the cam follower 13 normally abuts on the stopper 25 and is thereby held against further pivotal movement. On the other hand, the pre-hemming hem punch 10 is urged in a direction away from the hemming die 5 by an urging force of the return springs 15 and thereby held at a standby position.

The second to sixth inner periphery pre-hemming mechanisms A2 to A6 basically have the same configuration as the first inner periphery pre-hemming mechanism A1 and are different from it only in the shape of the hem punch 10 and the length and placement of the connecting member 16. Therefore, a description thereof is not given.

As shown in FIG. 2, the seventh inner periphery pre-hemming mechanism A7 includes a pre-hemming hem punch 30, a hem punch support member 31 supporting the pre-hemming hem punch 30, a cam follower 32, and return springs 33. The pre-hemming hem punch 30, the hem punch support member 31, the cam follower 32 and the return springs 33 are disposed on the lower platen 3 to come inside the opening of the outer panel W1. The cam follower 32 is mounted on the hem punch support member 31. The hem punch support member 31 supports the hem punch 30, like the hem punch 10 of the first inner periphery pre-hemming mechanism A1, to allow the hem punch 30 to be switched between a standby position and a pre-hemming position. The eighth inner periphery pre-hemming mechanism A8 has the same configuration as the seventh inner periphery pre-hemming mechanism A7.

Figure 6:
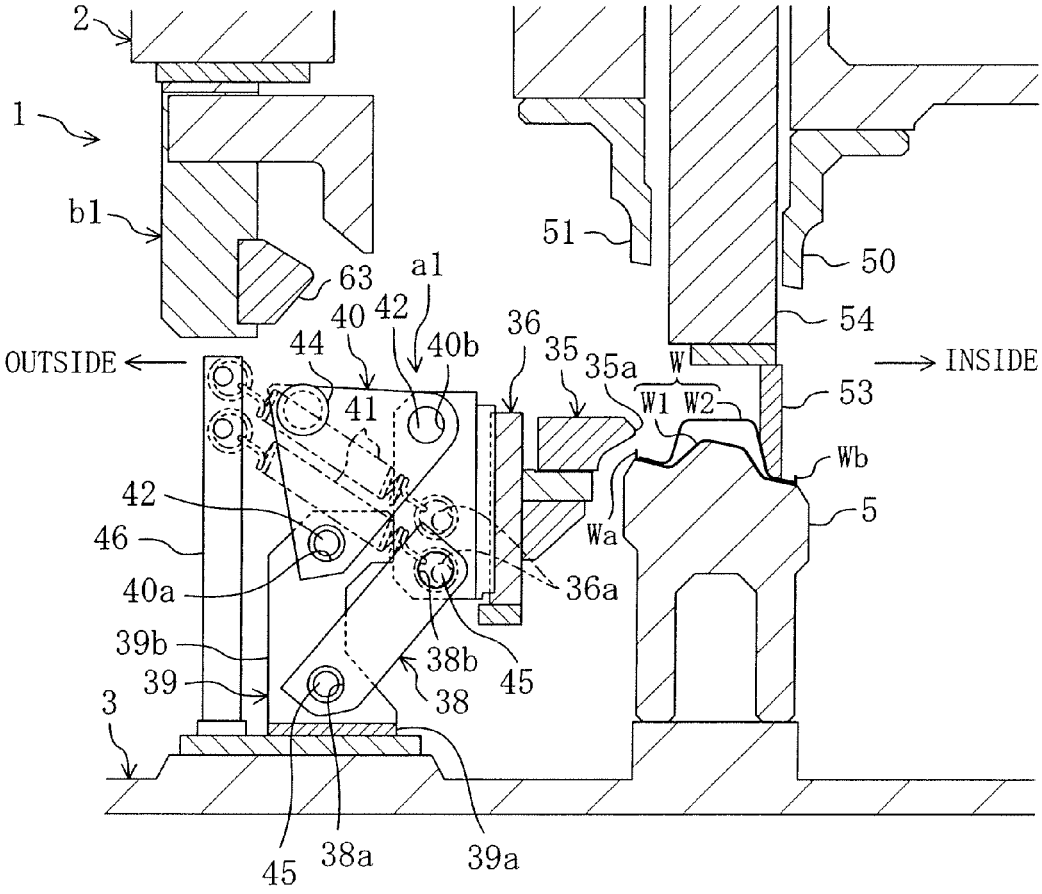
FIG. 6 is a cross-sectional view showing a first outer periphery pre-hemming mechanism of the hemming apparatus.

As shown in FIG. 6, the first outer periphery pre-hemming mechanism a1 includes a pre-hemming hem punch 35, a hem punch support member 36 supporting the pre-hemming hem punch 35, a link member 38, a bracket 39, a cam follower 40 and return springs 41. The pre-hemming hem punch 35, the hem punch support member 36, the link member 38, the cam follower 40 and the return springs 41 are disposed on the lower platen 3 to come outside the opening of the outer panel W1.

The pre-hemming hem punch 35 is formed to come alongside the upper left corner of the outer panel W1. The pre-hemming hem punch 35 has a forming part 35*a* extending from its top towards the inside (the center) of the lower platen 3. The forming part 35*a* is used to be pressed against the outer periphery bent portion Wa so that a hemming force acts on the outer periphery bent portion Wa.

The pre-hemming hem punch 35 is mounted on the side of the hem punch support member 36 located towards the hemming die 5. Formed in the opposite side of the hem punch support member 36 to the hemming die 5 are two bearing holes (not shown) horizontally passing through the hem punch support member 36 and vertically spaced apart from each other. Furthermore, the hem punch support member 36 includes two rods 36*a* and 36*a* extending laterally and vertically spaced apart from each other. The return springs 41 and 41 are anchored at their one ends to the respective rods 36*a* and 36*a*.

The bracket 39 includes a bottom plate 39*a* fixed to the lower platen 3 and a vertical plate 39*b* extending upward from the top surface of the bottom plate 39*a*. The vertical plate 39*b* has two bearing holes (not shown) formed vertically spaced apart from each other.

The link member 38 connects the hem punch support member 36 to the bracket 39. The link member 38 is formed in the shape of a substantially rectangular plate and has a through hole 38*a* formed to correspond to the lower bearing hole in the bracket 39 and a through hole 38*b* formed to correspond to the lower bearing hole in the hem punch support member 36. A shaft 45 is inserted into each of the lower bearing holes and the associated through hole 38*a*, 38*b*.

The cam follower 40 constitutes a parallel link mechanism together with the link member 38 and is formed in an approximately triangular shape in side view. The cam follower 40 has a through hole 40*a* formed in the vicinity of one of the three vertices to correspond to the upper bearing hole in the bracket 39 and a through hole 40*b* formed in the vicinity of another vertex to correspond to the upper bearing hole in the hem punch support member 36. A shaft 42 is inserted into each of the upper bearing holes and the associated through hole 40*a*, 40*b*. Mounted to the vicinity of the remaining vertex of the link member 38 is a roller 44 rotatably supported to a shaft (not shown) extending in parallel with the through hole 40*b*.

The roller 44 is configured to be engageable against the below-described driver cam to receive a force from the driver cam.

Figure 13:
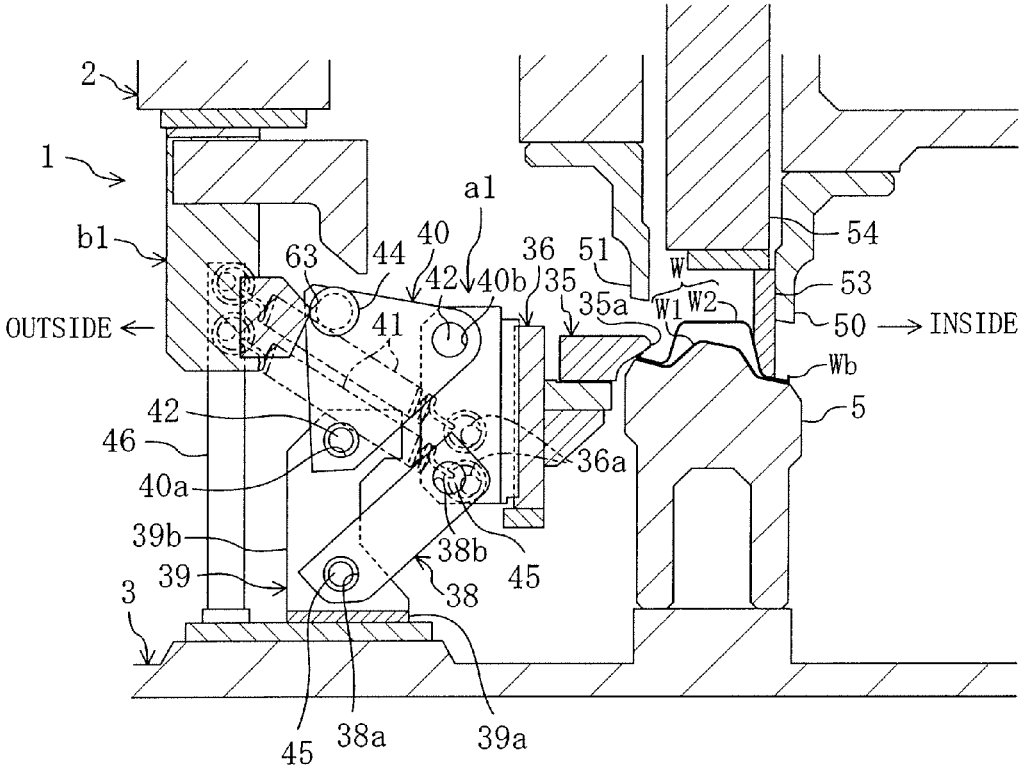
FIG. 13 is a corresponding view of FIG. 6 when a preliminary hemming of the outer periphery bent portion is completed.

Furthermore, disposed on the lower platen 3 outwardly of the bracket 39 is a return spring anchor member 46 at which the other ends of the return springs 41 are anchored. Each return spring 41 is used to urge the hem punch support member 36 upward and composed of a well-known tension spring. While being urged by the return springs 41, the hem punch support member 36 normally abuts on the stopper (not shown) and is thereby held against further pivotal movement. With the above configuration, the pre-hemming hem punch 35 of the first outer periphery pre-hemming mechanism a1 is switched between a standby position (shown in FIG. 6) away from the outer periphery bent portion Wa and a pre-hemming position (shown in FIG. 13) at which the pre-hemming hem punch 35 is pressed against the outer periphery bent portion Wa to preliminarily hem it.

The second to eighth outer periphery pre-hemming mechanisms a2 to a8 basically have the same configuration as the first outer periphery pre-hemming mechanism a1 and, therefore, a description thereof is not given.

Figure 5:
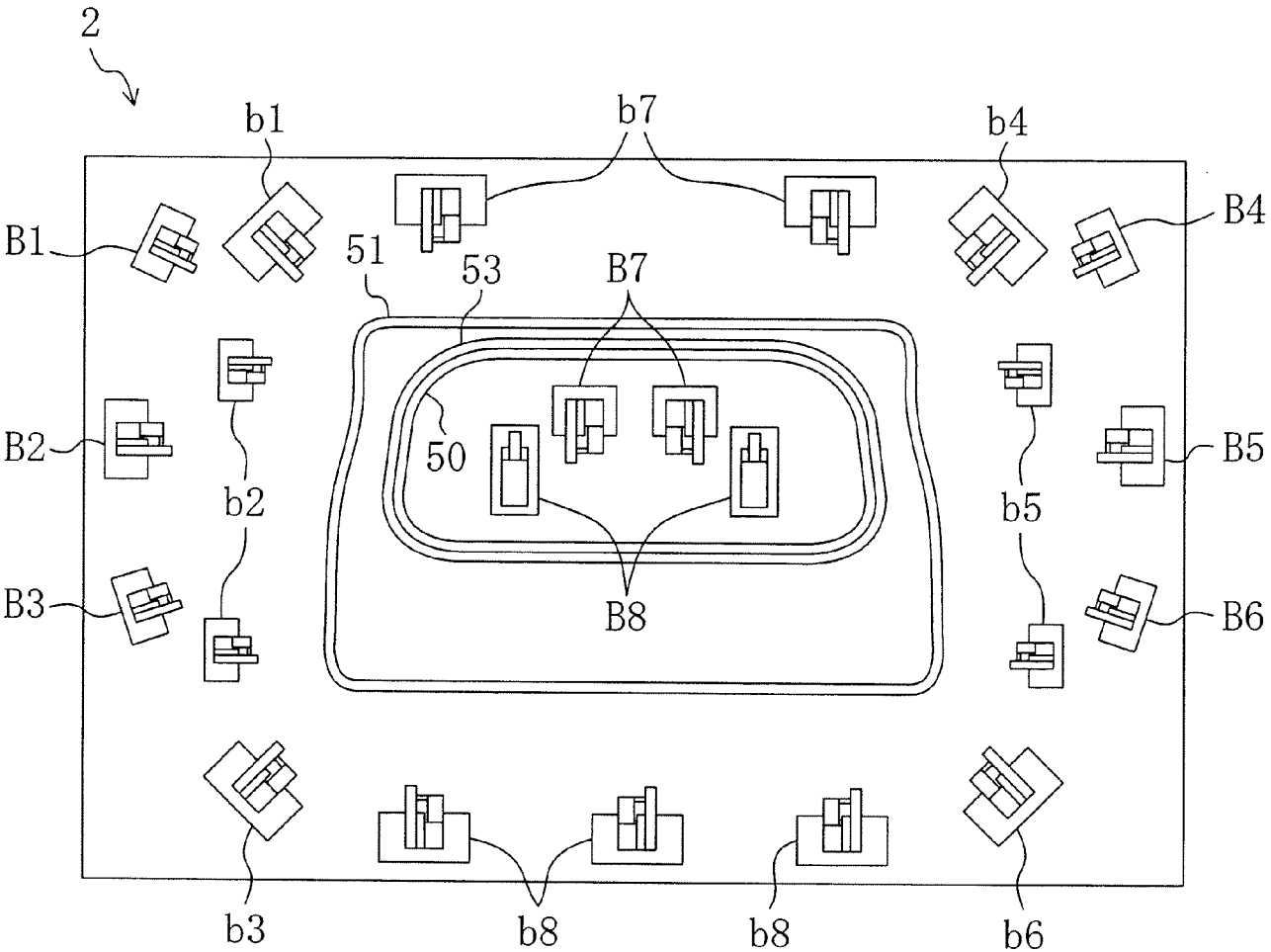
FIG. 5 shows an upper platen of the hemming apparatus as viewed from below.

As shown in FIGS. 1 and 5, the bottom surface of the upper platen 2 is provided with an inner periphery final hemming hem punch 50 for finally hemming the inner periphery bent portion Wb of the outer panel W1. The inner periphery final hemming hem punch 50 has an annular shape along the inner periphery bent portion Wb and is formed to extend below from the bottom surface of the upper platen 2. The bottom surface of the upper platen 2 is provided also with an outer periphery final hemming hem punch 51 for finally hemming the outer periphery bent portion Wa of the outer panel W1. The outer periphery final hemming hem punch 51 has an annular shape to surround the outer periphery of the inner periphery final hemming hem punch 50 and is formed likewise to extend below from the bottom surface of the upper platen 2. The inner periphery final hemming hem punch 50 and the outer periphery final hemming hem punch 51 have their respective lengths of extension adjusted to concurrently abut against the inner periphery bent portion Wb and outer periphery bent portion Wa, respectively, of the outer panel W1.

The upper platen 2 is provided also with a presser 53 between the inner periphery final hemming hem punch 50 and the outer periphery final hemming hem punch 51. The presser 53 is configured to press the inner panel W2 put on the hemming die 5 from above to hold the inner panel W2 and the outer panel W1 against movement. As shown in FIG. 1, a well-known gas spring 54 is disposed between the presser 53 and the upper platen 2 to vertically extend and retract. The presser 53 is mounted on the lower end of the gas spring 54 and urged downward by the gas spring 54. The presser 53 is configured to press the inner panel W2 and the outer panel W1 against the hemming die 5 prior to abutment of the first to eighth inner periphery pre-hemming mechanisms A1 to A8 against the inner periphery bent portion Wb and prior to abutment of the pre-hemming hem punches 35 of the first to eighth outer periphery pre-hemming mechanisms a1 to a8 against the outer periphery bent portion Wa.

As shown in FIG. 5, the upper platen 2 is provided also with first to sixth inner periphery driver cams B1 to B6 engageable against the respective cam followers 13 of the first to sixth inner periphery pre-hemming mechanisms A1 to A6. The first to sixth inner periphery driver cams B1 to B6 are disposed on the upper platen 2 outwardly of the outer periphery final hemming hem punch 51 in correspondence with the respective cam followers 13 of the first to sixth inner periphery pre-hemming mechanisms A1 to A6. The driver cams B1 to B6 are formed to extend downward from the upper platen 2.

Figure 7:
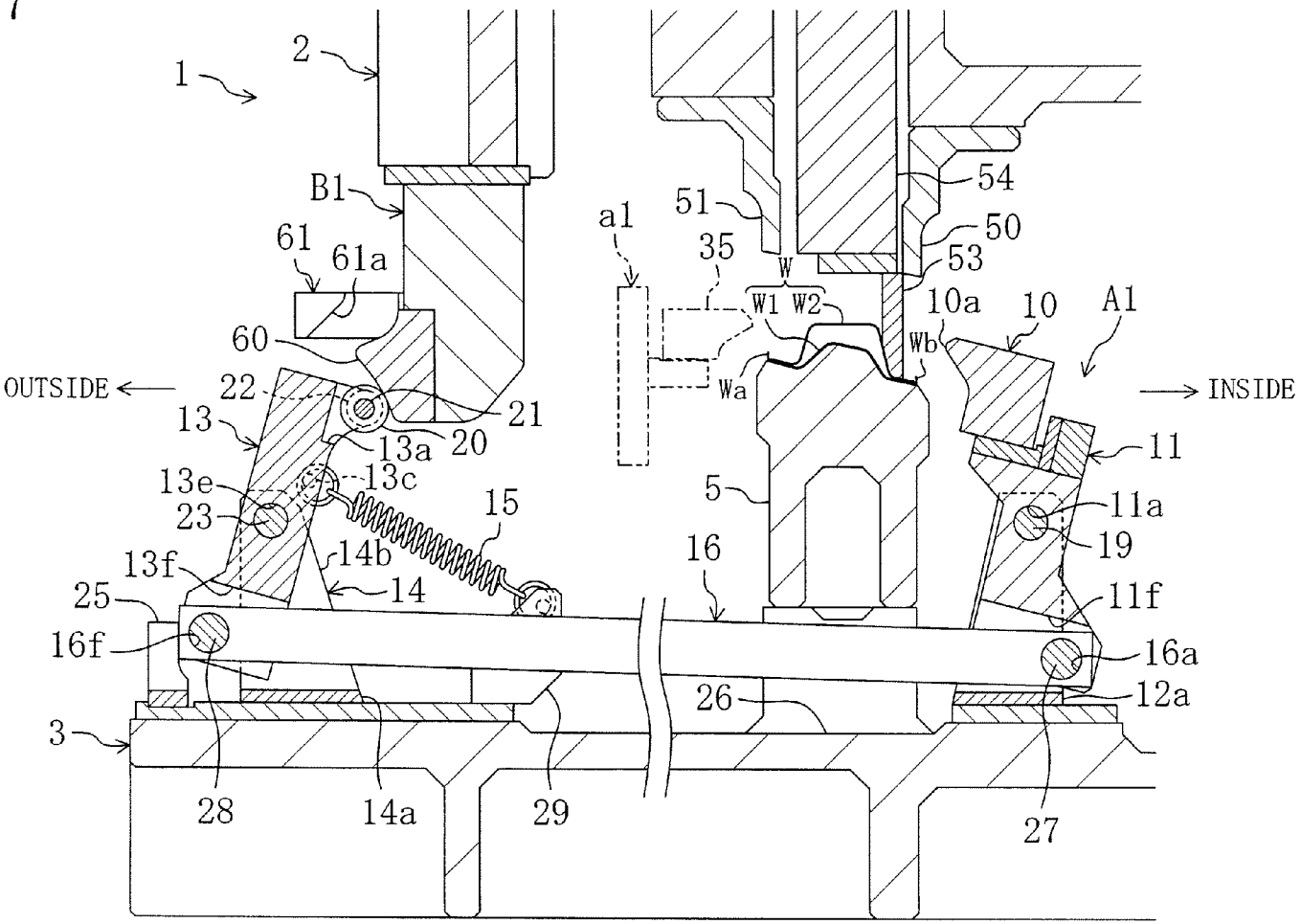
FIG. 7 is a corresponding view of FIG. 1 when a driver cam is engaged against a cam follower.
Figure 8:
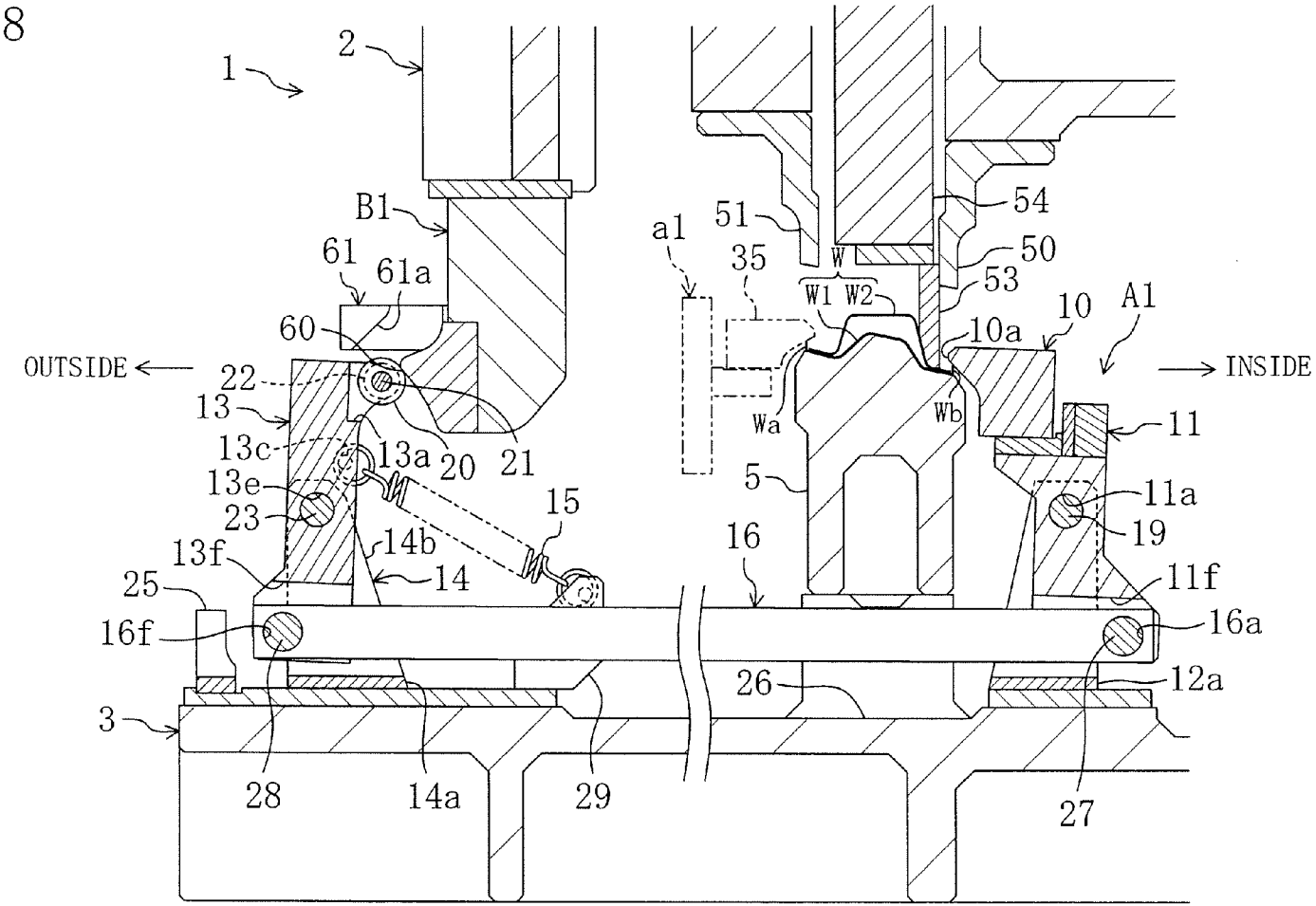
FIG. 8 is a corresponding view of FIG. 1 when a pre-hemming hem punch abuts on an inner periphery bent portion of a workpiece.
Figure 10:
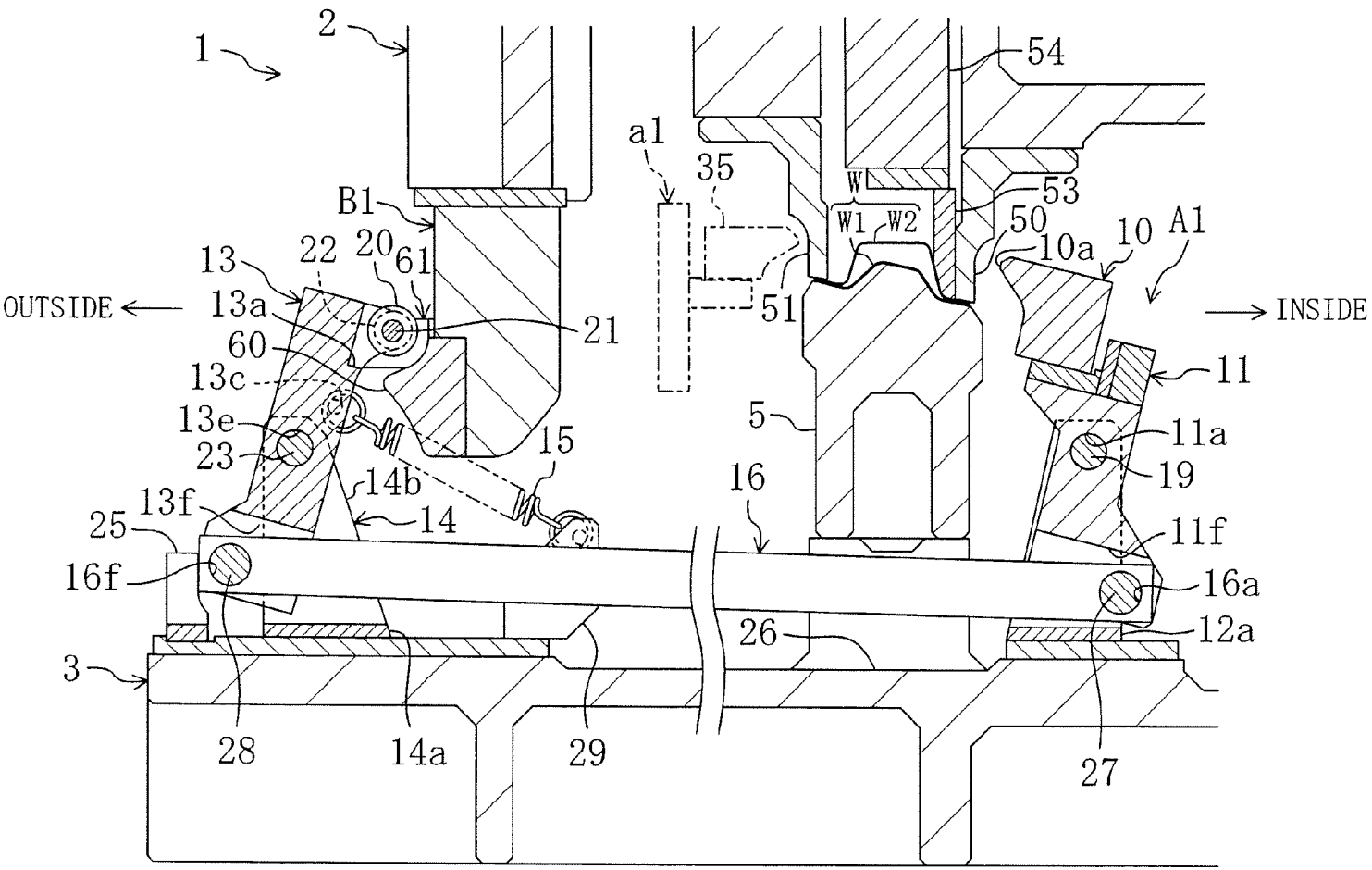
FIG. 10 is a corresponding view of FIG. 1 when a final hemming of the inner periphery bent portion is completed.

As shown in FIG. 1, the cam surface 60 of the first inner periphery driver cam B1 is formed to extend in a vertical direction and so that its vertical middle extends towards the outside of the upper platen 2. Specifically, the cam surface 60 is configured to come away from the associated cam follower 13 when the upper platen 2 is positioned at its rising end, whereby the pre-hemming hem punch 10 urged by the return springs 15 comes to its standby position. Furthermore, as shown in FIGS. 7 and 8, when the upper platen 2 is moved down from the rising end to come close to the lower platen 3, the cam surface 60 engages against the roller 20 of the cam follower 13 to press the roller 20 towards the outside of the lower platen 3 and pivotally move the cam follower 13. The amount of pivotal movement of the cam follower 13 at this time is determined from the shape of the cam surface 60. Specifically, it is the amount of movement of the pre-hemming hem punch 10 from its standby position to its pre-hemming position. As shown in FIG. 10, when the upper platen 2 is further moved down, the cam surface 60 comes away from the roller 20, whereby the pre-hemming hem punch 10 comes to its standby position.

The first inner periphery driver cam B1 includes a forcibly return part 61 for forcibly returning the pre-hemming hem punch 10 to the standby position when the pre-hemming hem punch 10 cannot return from the pre-hemming position to the standby position, such as because the return springs 15 break down. The forcibly return part 61 is formed to extend towards the outside of the upper platen 2. The forcibly return part 61 has a groove 61*a* formed to be engageable against the outer periphery of the cylindrical member 22 of the cam follower 13. When the pre-hemming hem punch 10 cannot return from the pre-hemming position to the standby position, the outer periphery of the cylindrical member 22 engages against the inner surface of the groove 61*a*, whereby a force to urge the pre-hemming hem punch 10 towards the standby position acts on the cam follower 13. The second to sixth inner periphery driver cams B2 to B6 have the same configuration as the first inner periphery driver cam B1 and are disposed on the upper platen 2 outwardly of the outer periphery final hemming hem punch 51.

As shown in FIG. 5, the upper platen 2 is provided also with seventh and eighth inner periphery driver cams B7 and B8 engageable against the respective cam followers 32 of the seventh and eighth inner periphery pre-hemming mechanisms A7 and A8. The seventh and eighth inner periphery driver cams B7 and B8 are disposed on the upper platen 2 inwardly of the inner periphery final hemming hem punch 50 in correspondence with the respective cam followers 32 of the seventh and eighth inner periphery pre-hemming mechanisms A7 and A8. The seventh and eighth inner periphery driver cams B7 and B8 have the same configuration as the first inner periphery driver cam B1.

The upper platen 2 is provided also with first to eighth outer periphery driver cams b1 to b8 engageable against the respective cam followers of the first to eighth outer periphery pre-hemming mechanisms a1 to a8. The first to eighth outer periphery driver cams b1 to b8 are disposed on the upper platen 2 outwardly of the outer periphery final hemming hem punch 51 in correspondence with the respective cam followers of the first to eighth outer periphery pre-hemming mechanisms a1 to a8.

As shown in FIG. 6, the first outer periphery driver cam b1 is formed to extend downward from the upper platen 2. The cam surface 63 of the driver cam b1 extends in a vertical direction and, like the inner periphery driver cam B1, is configured to switch the pre-hemming hem punch 35 between a standby position and a pre-hemming position.

The timings of movement and amounts of movement of the first to eighth inner periphery pre-hemming mechanisms A1 to A8 can be appropriately selected according to the respective shapes of the cam surfaces 60 of the inner periphery driver cams B1 to B8, while the timings of movement and amounts of movement of the first to eighth outer periphery pre-hemming mechanisms a1 to a8 can be appropriately selected according to the respective shapes of the cam surfaces 63 of the outer periphery driver cams b1 to b8.

Next, a description is given of hemming of the inner periphery bent portion Wb and outer periphery bent portion Wa of the outer panel W1 using the hemming apparatus 1 having the above structure. First, as shown in FIGS. 1 and 6, the upper platen 2 is positioned at its rising end. In this state, the pre-hemming hem punches 10 and 35 are put into their standby positions by urging forces of the return springs 15 and 41. Then, the outer panel W1 and the inner panel W2 are laid over each other and put on the hemming die 5.

Next, the upper platen 2 is moved down. Then, the presser 53 is first pressed against the inner panel W2 and held against further downward movement, whereby the gas spring 54 contracts. Thus, the outer panel W1 and the inner panel W2 are pressed against the hemming die 5 and thereby set in place. Thereafter, as shown in FIG. 7, the first to eighth inner periphery driver cams B1 to B8 start to engage against the cam followers 13 of the first to eighth inner periphery pre-hemming mechanisms A1 to A8 all together and, concurrently, as shown in FIG. 10, the first to eighth outer periphery driver cams b1 to b8 start to engage against the cam followers 40 of the first to eighth outer periphery pre-hemming mechanisms a1 to a8 all together.

Figure 9:
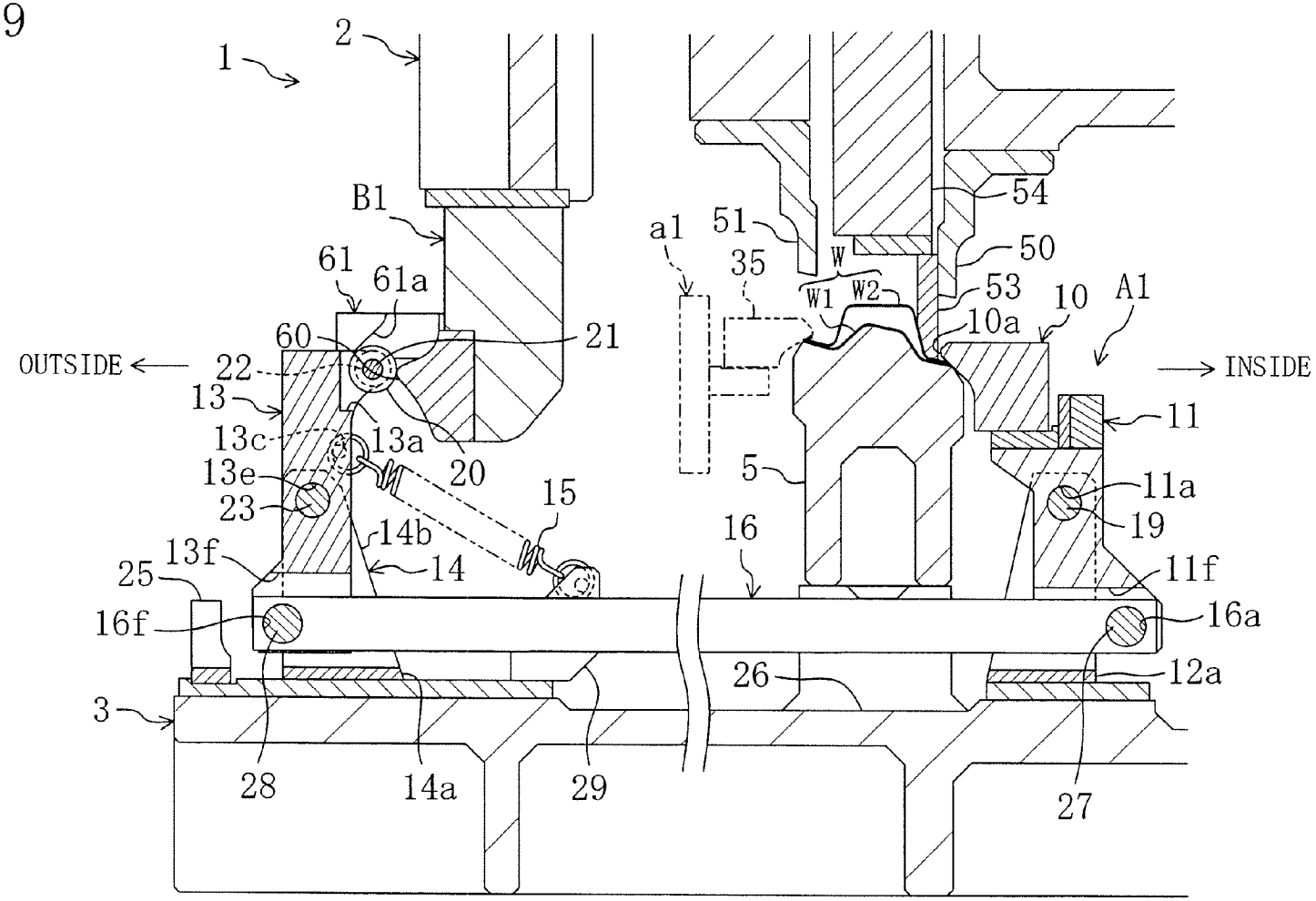
FIG. 9 is a corresponding view of FIG. 1 when a preliminary hemming of the inner periphery bent portion is completed.

When the first inner periphery driver cam B1 engages against the cam follower 13 of the first inner periphery pre-hemming mechanism A1, as shown in FIG. 8, the upper part of the cam follower 13 is pushed towards the outside of the lower platen 3 by the cam surface 60. Thus, the cam follower 13 pivotally moves about the follower-side shaft 23 to push the connecting member 16 towards the inside (the center) of the lower platen 3. The connecting member 16 pushes the lower part of the hem punch mounting member 11 towards the inside (the center) of the lower platen 3, whereby the hem punch mounting member 11 pivotally moves about the hem punch-side shaft 19 so that, as shown in FIG. 9, the pre-hemming hem punch 10 switches to the pre-hemming position. Thus, the forming part 10*a* is pressed against the inner periphery bent portion Wb, whereby the inner periphery bent portion Wb is folded down and a preliminary hemming is completed.

The upper platen 2 continues to move down even after the completion of the preliminary hemming. Thus, as shown in FIG. 10, the cam follower 13 pivotally moves back by an urging force of the return springs 15 to pull the connecting member 16 towards the outside of the lower platen 3. The connecting member 16 pulls the lower part of the hem punch mounting member 11 towards the outside of the lower platen 3, whereby the hem punch mounting member 11 pivotally moves about the hem punch-side shaft 19 so that the pre-hemming hem punch 10 switches to the standby position.

Figure 11:
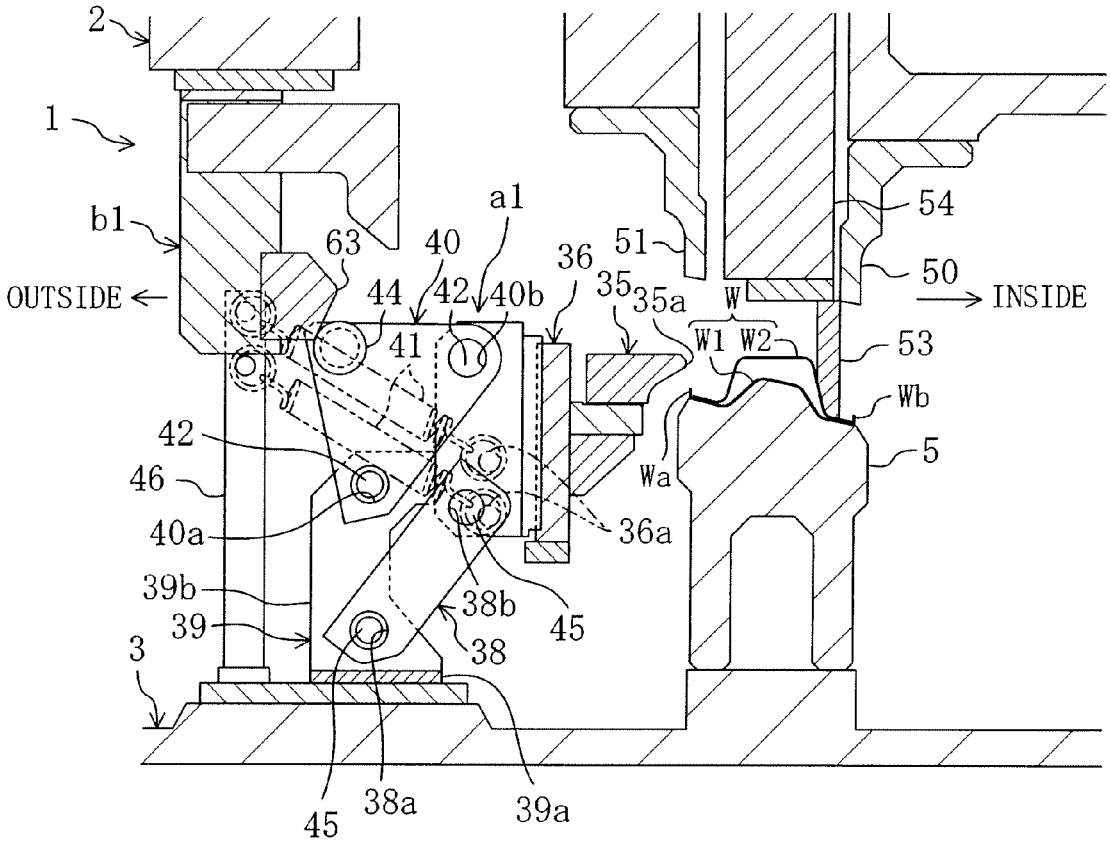
FIG. 11 is a corresponding view of FIG. 6 when a driver cam is engaged against a cam follower.
Figure 12:
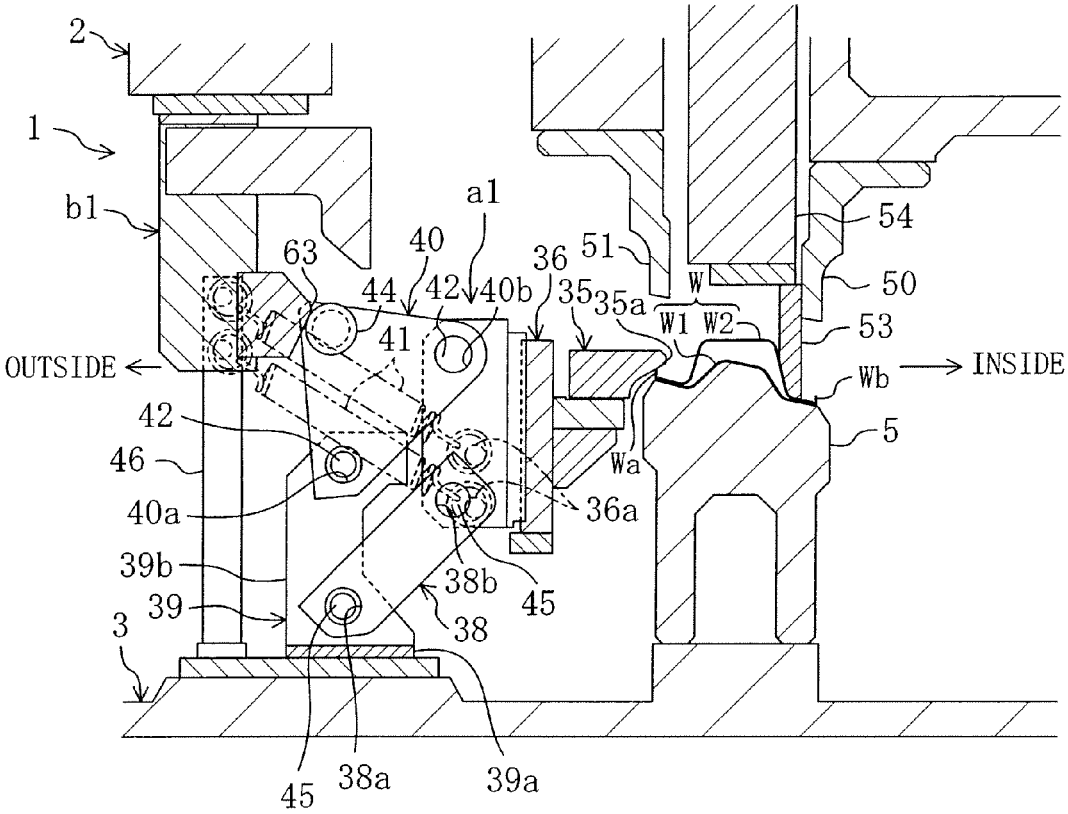
FIG. 12 is a corresponding view of FIG. 6 when a pre-hemming hem punch abuts on an outer periphery bent portion of the workpiece.

On the other hand, as shown in FIG. 11, when the first outer periphery driver cam b1 engages against the cam follower 40 of the first outer periphery pre-hemming mechanism a1, the cam follower 40 is pushed by the cam surface 63 so that the pre-hemming hem punch 35 switches to the pre-hemming position and its preliminary hemming is completed. Thereafter, as shown in FIG. 14, when the upper platen 2 further moves down, the pre-hemming hem punch 35 switches to the standby position.

Figure 14:
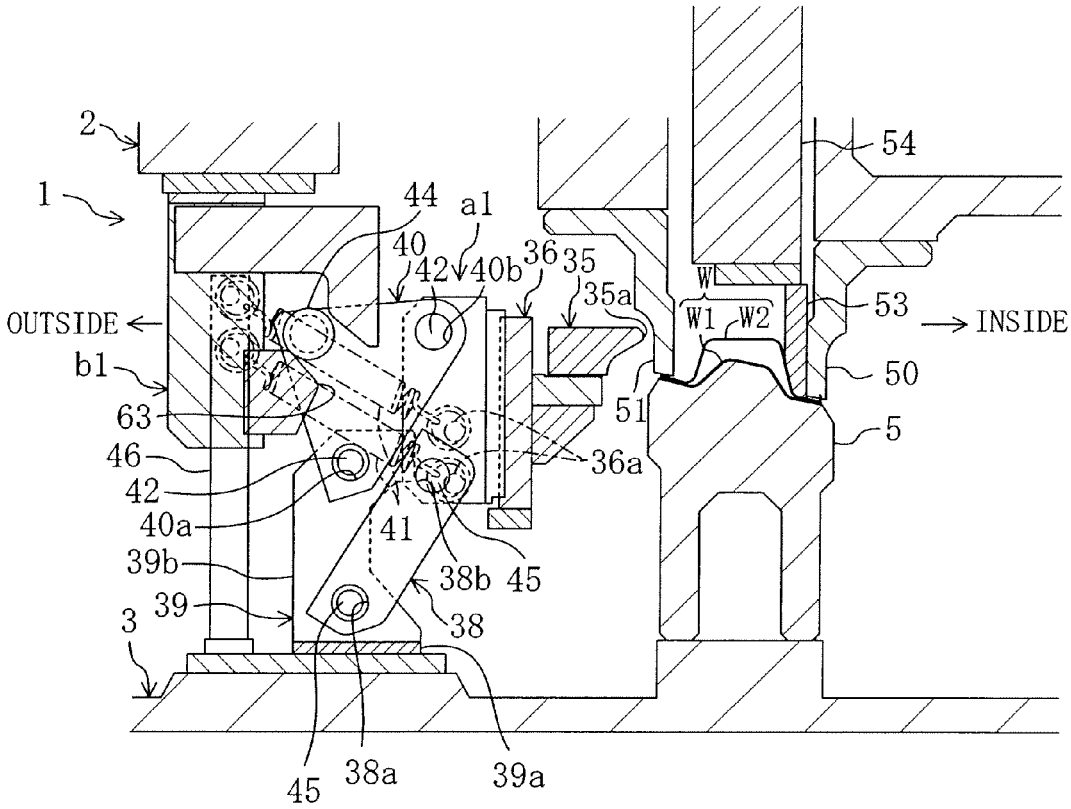
FIG. 14 is a corresponding view of FIG. 6 when a final hemming of the outer periphery bent portion is completed.

The upper platen 2 continues to further move down also after both the pre-hemming hem punches 10 and 35 return to their standby positions, whereby, as shown in FIGS. 10 and 14, the inner periphery final hemming punch 50 and outer periphery final hemming punch 51 are pressed against the inner periphery bent portion Wb and the outer periphery bent portion Wa, respectively. Thus, the inner periphery bent portion Wb and the outer periphery bent portion Wa are finally hemmed. Thereafter, the upper platen 2 is moved up and the workpiece W is picked up.

As described so far, according to the hemming apparatus 1 of this embodiment, the cam followers 13 are disposed to come outside the frame of the workpiece W and each of the cam followers 13 located outside of the frame and the associated pre-hemming hem punch 10 are connected by the connecting member 16. Therefore, even if the opening of the workpiece W is to small to dispose the cam followers 13 within it, the entire inner periphery bent portion Wb of the workpiece W can be hemmed. Thus, the inner periphery bent portion Wb of the workpiece W can be hemmed in a single step with a single lower platen 3, which reduces the cost while giving the product a good quality.

Furthermore, the connecting members 16 are disposed to the opposite side of the workpiece W supported on the hemming die 5 to the upper platen 2. Therefore, when the upper platen 2 is moved, it does not interfere with the connecting members 16 and thereby can be easily moved.

Although in the above embodiment the hemming apparatus 1 includes eight inner periphery pre-hemming mechanisms A1 to A8, the hemming apparatus according to the present invention may include a single inner periphery pre-hemming mechanism.

Furthermore, although in the above embodiment the cam followers 32 of the seventh cam followers 32 is not limited to this. For example, like the cam follower of the first inner periphery pre-hemming mechanism A1, the cam followers of the seventh and eighth inner periphery pre-hemming mechanisms A7 and A8 may also be disposed on the lower platen 3 to come outside the frame of the workpiece W.

Furthermore, the timings of movement of the first to eighth inner periphery pre-hemming mechanisms A1 to A8 may differ from one another in order to avoid interference between their associated pre-hemming hem punches.

Although the above embodiment describes the case of hemming of a panel constituting part of a vehicle door using the hemming apparatus 1 according to the present invention, the hemming apparatus 1 can be used also when hemming various metallic panels other than vehicle door panels. Vehicle doors with which the hemming apparatus 1 can deal include tail gates and sliding doors. However, the hemming apparatus 1 can deal also with various lids and covers for vehicles.

INDUSTRIAL APPLICABILITY

As can be seen from the above description, the hemming apparatus according to the present invention can be used in hemming, for example, a panel constituting part of a door for a motor vehicle.

What is claimed is:

1. A hemming apparatus for hemming an inner periphery bent portion of a workpiece having a frame, the inner periphery bent portion being previously formed at the inner periphery of the workpiece, the hemming apparatus comprising:

a first platen including a support table for supporting the workpiece thereon; and a second platen disposed to face the first platen, wherein the first platen further includes an inner periphery hem punch disposed to come inside the frame of the workpiece and capable of being pressed against the inner periphery bent portion, an outside cam follower disposed to come outside the frame of the workpiece, and a connecting member connecting the outside cam follower and the inner periphery hem punch to transmit the movement of the outside cam follower to the inner periphery hem punch, the second platen includes an outside driver cam engageable against the outside cam follower by relative movement of the second platen towards the first platen, and the outside driver cam is configured to move the outside cam follower so that the inner periphery hem punch reaches a position to be pressed against the inner periphery bent portion.

2. The hemming apparatus of claim 1, wherein the connecting member is disposed to the opposite side of the workpiece supported on the support table to the second platen.

3. The hemming apparatus of claim 1, wherein the first platen includes a first inner periphery hem punch, a second inner periphery hem punch and an inside cam follower connected to the first inner periphery hem punch, the first and second inner periphery hem punches and the inside cam follower being disposed to come inside the frame of the workpiece, the second inner periphery hem punch and the outside cam follower are connected through the connecting member, the second platen further includes an inside driver cam engageable against the inside cam follower by relative movement of the second platen towards the first platen, and the inside driver cam is configured to move the inside cam follower so that the first inner periphery hem punch reaches a position to be pressed against the inner periphery bent portion.

4. The hemming apparatus of claim 1, wherein the first platen further includes a return spring for the outside cam follower, the return spring being disposed to come outside the frame of the workpiece.

* * * * *